US010593531B2

(12) United States Patent
Mizutani

(10) Patent No.: US 10,593,531 B2
(45) Date of Patent: Mar. 17, 2020

(54) TIME-OF-FLIGHT MASS SPECTROMETER

(71) Applicant: SHIMADZU CORPORATION, Kyoto-shi, Kyoto (JP)

(72) Inventor: Shiro Mizutani, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/315,883

(22) PCT Filed: Aug. 22, 2016

(86) PCT No.: PCT/JP2016/074336
§ 371 (c)(1),
(2) Date: Jan. 7, 2019

(87) PCT Pub. No.: WO2018/037440
PCT Pub. Date: Mar. 1, 2018

(65) Prior Publication Data
US 2019/0157058 A1 May 23, 2019

(51) Int. Cl.
*H01J 49/02* (2006.01)
*H01J 49/40* (2006.01)

(52) U.S. Cl.
CPC ..... *H01J 49/022* (2013.01); *H01J 49/40* (2013.01); *H01J 49/403* (2013.01)

(58) Field of Classification Search
CPC ..... H01J 49/022; H01J 49/40; H01J 49/403
See application file for complete search history.

(56) References Cited

U.S. PATENT DOCUMENTS 6,700,118 B2 3/2004 Yefchak et al.
2006/0083032 A1* 4/2006 McDonald ..... H02M 3/33592 363/21.12

(Continued)

FOREIGN PATENT DOCUMENTS

JP 5-304451 A 11/1993
JP 2001-283767 A 10/2001
JP 2014-22162 A 2/2014

OTHER PUBLICATIONS

Communication dated Jul. 18, 2019, from the European Patent Office in counterpart European Application No. 16914115.7.

(Continued)

*Primary Examiner* — Nicole M Ippolito
*Assistant Examiner* — Sean M Luck
(74) *Attorney, Agent, or Firm* — Sughrue Mion, PLLC

(57) ABSTRACT

An acceleration voltage generator generates a high-voltage pulse applied to a push-out electrode, by operating a switch section to turn on and off a high direct-current voltage generated by a high-voltage power supply. A drive pulse signal is supplied from a controller to the switch section through a primary-side drive section, transformer, and secondary-side drive section. A primary-voltage controller receives a measurement result of ambient temperature of the acceleration voltage generator from a temperature sensor, and controls a primary-side power supply to change a primary-side voltage according to the temperature, thereby adjusting the voltage applied between the two ends of a primary winding of the transformer. The adjustment made on the primary-side voltage changes a slope angle of rise of a gate voltage in the MOSFET, and enables a correction to a discrepancy in the timing of the rise/fall of the high-voltage pulse caused by change in ambient temperature.

2 Claims, 8 Drawing Sheets

(56) References Cited

U.S. PATENT DOCUMENTS

| | | | | |
|---|---|---|---|---|
| 2008/0123815 | A1* | 5/2008 | Feda | G01N 23/223 378/112 |
| 2012/0113551 | A1* | 5/2012 | Huang | H02H 5/041 361/18 |
| 2017/0323773 | A1* | 11/2017 | Mizutani | H02M 7/10 |

OTHER PUBLICATIONS

International Search Report for PCT/JP2016/074336 dated Nov. 22, 2016 [PCT/ISA/210].
Written Opinion for PCT/JP2016/074336 dated Nov. 22, 2016 [PCT/ISA/237].

* cited by examiner

TIME-OF-FLIGHT MASS SPECTROMETER

CROSS REFERENCE TO RELATED APPLICATIONS

This application is a National Stage of International Application No. PCT/JP2016/074336, filed on Aug. 22, 2016.

TECHNICAL FIELD

The present invention relates to a time-of-flight mass spectrometer. More specifically, the present invention relates to a high-voltage power supply device configured to apply a high voltage to a predetermined electrode or electrodes in an ion ejector of a time-of-flight mass spectrometer so that ions are given acceleration energy for flying.

BACKGROUND ART

In a time-of-flight mass spectrometer (TOFMS), various ions derived from a sample are ejected from an ion ejector, and the time of flight required for each ion to fly a certain flight distance is measured. Each ion flies at a speed according to its mass-to-charge ratio m/z. Accordingly, the above-mentioned time of flight corresponds to the mass-to-charge ratio of the ion, and the mass-to-charge ratio of the ion can be determined based on its time of flight.

FIG. 13 is a schematic configuration diagram of a typical orthogonal acceleration TOFMS (hereinafter, it may be referred to as "OA-TOFMS").

In FIG. 13, ions generated from a sample in an ion source (not shown) are introduced into an ion ejector 1 in the Z-axis direction, as shown by an arrow in FIG. 13. The ion ejector 1 includes a plate-shaped push-out electrode 11 and a grid-shaped extraction electrode 12, which are arranged to face each other. Based on control signals from a controller 6, an acceleration voltage generator 7 applies a predetermined level of high-voltage pulse to either the push-out electrode 11 or the extraction electrode 12, or to both, at a predetermined timing. By this operation, ions passing through the space between the push-out electrode 11 and the extraction electrode 12 are given acceleration energy in the X-axis direction and ejected from the ion ejector 1 into a flight space 2. The ions fly through the flight space 2 which has no electric field, and then enter a reflector 3.

The reflector 3 includes a plurality of annular reflection electrodes 31 and a back plate 32. A predetermined direct-current voltage is applied to each of the reflection electrodes 31 and the back plate 32 from a reflection voltage generator 8. A reflective electric field is thereby formed within the space surrounded by the reflection electrodes 31. The ions are reflected by this electric field, and once more fly through the flight space 2, to eventually reach a detector 4. The detector 4 generates ion-intensity signals according to the amount of ions that have reached the detector 4, and sends those signals to a data processor 5. The data processor 5 creates a time-of-flight spectrum that shows the relationship between the time of flight and the ion-intensity signal, with the point in time of the ejection of the ions from the ion ejector 1 defined as the time-of-flight value of zero, and converts the time of flight to a mass-to-charge ratio based on prepared mass calibration information, so as to create a mass spectrum.

When ions are to be ejected from the ion ejector 1 of the above-mentioned GA-TOFMS, a high-voltage pulse having the magnitude on the order of kV with a short duration needs to be applied to the push-out electrode 11 and the extraction electrode 12. For generating such a high-voltage pulse, a power supply device as disclosed in Patent Literature 1 (it is referred to as a "pulsar power source" in this document) has been conventionally used.

The power supply device includes: a pulse generator for generating a low-voltage pulse signal for controlling the timing of the generation of the high-voltage pulse; a pulse transformer for transmitting the pulse signal from a control-system circuit to a power-system circuit while electrically insulating the control circuit that operates with a low voltage from the power circuit that operates with a high voltage; a driving circuit connected to the secondary winding of the pulse transformer; a high-voltage circuit for generating a high direct-current voltage; and a switching element employing metal-oxide-semiconductor field-effect transistors (MOSFETs) to generate a voltage pulse by turning on and off the direct-current voltage generated by the high-voltage circuit according to a control voltage provided through the driving circuit. Such circuits are not limited to TOFMSs; they are commonly used for generating high-voltage pulses (see Patent Literature 2 and others).

As described above, the TOFMS measures the time of flight for each of the ions, with the point in time of the ejection of the ions or the acceleration of the ions defined as the time-of-flight value of zero. Accordingly, in order to enhance the accuracy in the measurement of the mass-to-charge ratio, the point in time of the initiation of the time-of-flight measurement needs to coincide with the timing of the actual application of the high-voltage pulse to the push-out electrode or the like as much as possible.

The above-mentioned power supply device employs semiconductor components such as complementary metal-oxide semiconductor (CMOS) logic ICs and the MOSFETs, and the pulse transformer, so as to generate the high-voltage pulse based on the low-voltage pulse signal. With these components and elements, a transmission delay occurs between a point in time at which a certain signal is inputted and a point in time at which another signal is output in response to the signal. In addition, a certain degree of time for rise or fall of a voltage waveform (or current waveform) is required for a change in the voltage waveform (or current waveform). Such transmission delay time, rising time, and falling time are not always constant, and change according to the temperature of the components and the elements. Thus, a change in the ambient temperature of the power supply device causes a time discrepancy in the timing of the application of the high-voltage pulse to the push-out electrode or the like, and this time discrepancy causes a mass discrepancy in the mass spectrum to a certain extent.

In order to cope with the problems, a TOFMS disclosed in Patent Literature 3 measures the temperature of an electric circuit, and corrects the measured time-of-flight data according to the temperature measured, so as to resolve a mass discrepancy. In other words, when the ambient temperature of the power supply device differs from, for example, a standard temperature, this method allows an occurrence of discrepancy in the time of flight, and resolves the discrepancy by data processing. In this method, highly accurate correction information that indicates the relationship between the temperature discrepancy and the time-of-flight discrepancy needs to be prepared, so as to correct the time-of-flight discrepancy at high accuracy. However, the time of flight generally varies depending on various factors, for example, not only a temperature in each section, but also installation accuracy of components, such as a reflector and a detector, variation in reflective electric field caused by contamination of a reflector, and the like. Therefore, even when the above-mentioned correction information is prepared on certain conditions, highly accurate correction cannot always be achieved by utilizing the correction information.

Further, the data correction processing made after the measurement takes time and causes as much delay in preparing the mass spectrum. For example, when a mass spectrum obtained from a normal mass analysis should be analyzed in real time to determine a precursor ion for a subsequent operation, i.e., a mass spectrometry/mass spectrometry (MS/MS) analysis, a delay in the MS/MS analysis can occur.

CITATION LIST

Patent Literature

Patent Literature 1: JP 2001-283767 A
Patent Literature 2: JP H5-304451 A
Patent Literature 3: U.S. Pat. No. 6,700,118 B

SUMMARY OF INVENTION

Technical Problem

The present invention has been developed to solve the above problems. An object of the present invention is to provide a time-of-flight mass spectrometer in which a time discrepancy between a point in time of initiation of a time-of-flight measurement and that of ejection of ions is reduced so that a high level of mass accuracy can be achieved without correcting the time of flight and the like by data processing even when the ambient temperature of a power supply device that generates a high-voltage pulse for the ejection of ions is changed or the ambient temperature largely differs from a standard temperature.

Solution to Problem

The present invention developed for solving the above problems is a time-of-flight mass spectrometer provided with a flight space through which ions fly, an ion ejector for ejecting ions to be measured into the flight space by imparting acceleration energy to the ions by an effect of an electric field created by a voltage applied to an electrode, and an ion detector for detecting the ions having flown through the flight space, the time-of-flight mass spectrometer including:

a) a high-voltage pulse generator for applying, to the electrode of the ion ejector, a high-voltage pulse for ejecting ions, the high-voltage pulse generator including: a direct-current power supply for generating a high direct-current voltage; a transformer including a primary winding and a secondary winding; a primary-side drive circuit section for supplying drive current to the primary winding of the transformer in response to an input of a pulse signal for ejecting ions; a secondary-side drive circuit section connected to the secondary winding of the transformer; a switching element to be driven by the secondary-side drive circuit section to turn on and off for generating a voltage pulse from the high direct-current voltage generated by the direct-current power supply; and a primary-side power supply for generating a voltage to be applied between two ends of the primary winding of the transformer through the primary-side drive circuit section;

b) a temperature measurement section for measuring an ambient temperature of the high-voltage pulse generator; and c) a controller for controlling the primary-side power supply to change the voltage to be applied between the two ends of the primary winding of the transformer in the high-voltage pulse generator, according to the temperature measured by the temperature measurement section.

Generally, a voltage having a fixed value is applied between the two ends of the primary winding of the transformer in a high-voltage pulse generator. In contrast, in the time-of-flight mass spectrometer according to the present invention, the voltage applied between the two ends of the primary winding of the transformer is not fixed, but is adjustable by the primary-side power supply. The controller controls the primary-side power supply according to the ambient temperature of the high-voltage pulse generator, the ambient temperature being measured by the temperature measurement section, and causes the change in the voltage applied between the two ends of the primary winding of the transformer. When the voltage applied between the two ends of the primary winding of the transformer is changed, the peak value of the pulse signal applied to a control terminal in the switching element changes. Then, current that charges, for example, an input capacitance of the control terminal in the switching element changes, causing a change in an actual slope angle of rise and fall of the voltage in the control terminal. Consequently, a tuning at which the voltage slope crosses a threshold voltage in the switching element changes, causing a change in the timing of the rise/fall of the high-voltage pulse.

The controller adjusts the voltage applied between the two ends of the primary winding of the transformer to a voltage higher or lower by a predetermined voltage than the standard voltage according to, for example, a difference between the ambient temperature and a preset standard temperature. This causes a change in the actual slope angle of rise of the voltage in the control terminal of the switching element, so that the timing at which the slope crosses the threshold voltage becomes almost constant without being dependent on the ambient temperature. It is therefore possible, even when the ambient temperature differs from the standard temperature, to suppress the temporal change in rise of the high-voltage pulse, to always accelerate ions at almost the same timing, and to eject the ions into the flight space.

As one mode of the time-of-flight mass spectrometer according to the present invention, the controller may include a storage section for storing information showing a relationship between a change in the ambient temperature and a temporal change in the high-voltage pulse to be outputted and information showing a relationship between a change in the voltage applied between the two ends of the primary winding of the transformer and the temporal change in the high-voltage pulse to be outputted, and may control the primary-side power supply based on the information stored in the storage section.

With this configuration, it is possible to directly obtain an applied voltage according to the ambient temperature, by referring to the information stored in the storage section in advance. The configuration of the time-of-flight mass spectrometer is thus simplified. It is normally possible for a manufacturer of the time-of-flight mass spectrometer to experimentally determine the information to be stored in the storage section.

It should be noted that the time-of-flight mass spectrometer according to the present invention can be applied to any type of time-of-flight mass spectrometer in which ions are accelerated and sent into a flight space by an electric field formed by applying a high-voltage pulse to an electrode. Specifically, the present invention can be applied not only to an orthogonal acceleration time-of-flight mass spectrometer, but also to an ion-trap time-of-flight mass spectrometer in which ions held in an ion trap are accelerated and sent into a flight space, or a time-of-flight mass spectrometer in which ions generated from a sample by a matrix assisted laser desorption/ionization (MALDI) ion source or similar ion source are accelerated and sent into a flight space.

Advantageous Effects of Invention

In the time-of-flight mass spectrometer according to the present invention, the timing of the application of the high-voltage pulse to an electrode for ejecting ions can be constantly maintained even when the ambient temperature of the high-voltage pulse generator that generates a high-voltage pulse for the ejection of ions is changed or the ambient temperature largely differs from the standard temperature. This prevents a mass discrepancy in a mass spectrum caused by the change or difference in the ambient temperature, making it possible to obtain the mass spectrum at a high level of mass accuracy. Further, an influence of the difference in the ambient temperature from the standard temperature is not corrected by data processing after the data acquisition, but is corrected at the point in time of the measurement, more specifically at the point in time of ejection of the ions. Therefore, even when there are various factors causing a variation in the time of flight, it is possible to perform an accurate correction without being influenced by such factors. In addition, no time is required for the data processing for the correction after the data acquisition.

DESCRIPTION OF EMBODIMENTS

An OA-TOFMS according to one embodiment of the present invention is described as follows, with reference to the attached drawings.

Figure 1:
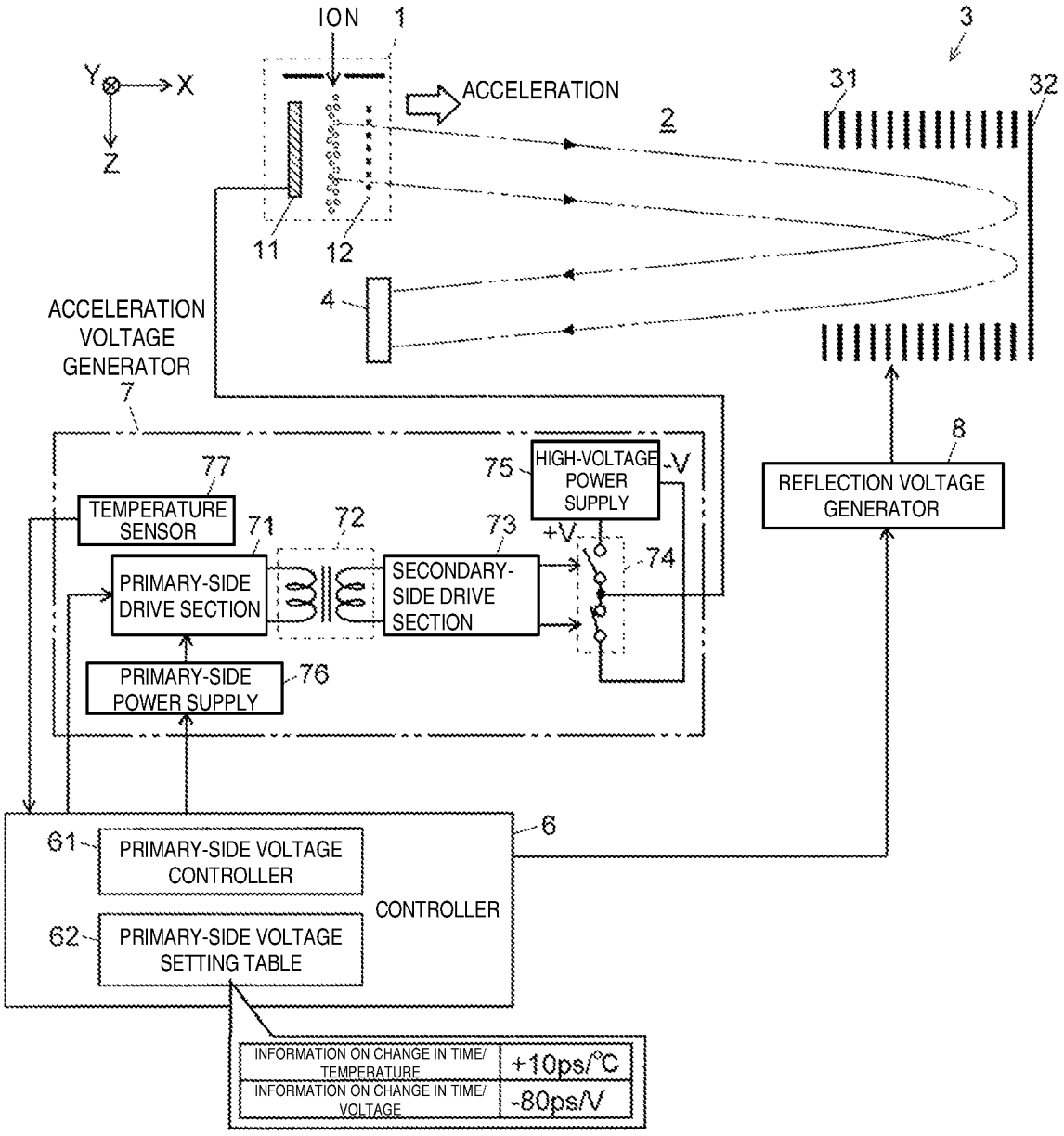
FIG. 1 is a schematic configuration diagram showing an OA-TOFMS according to one embodiment of the present invention.
Figure 3:
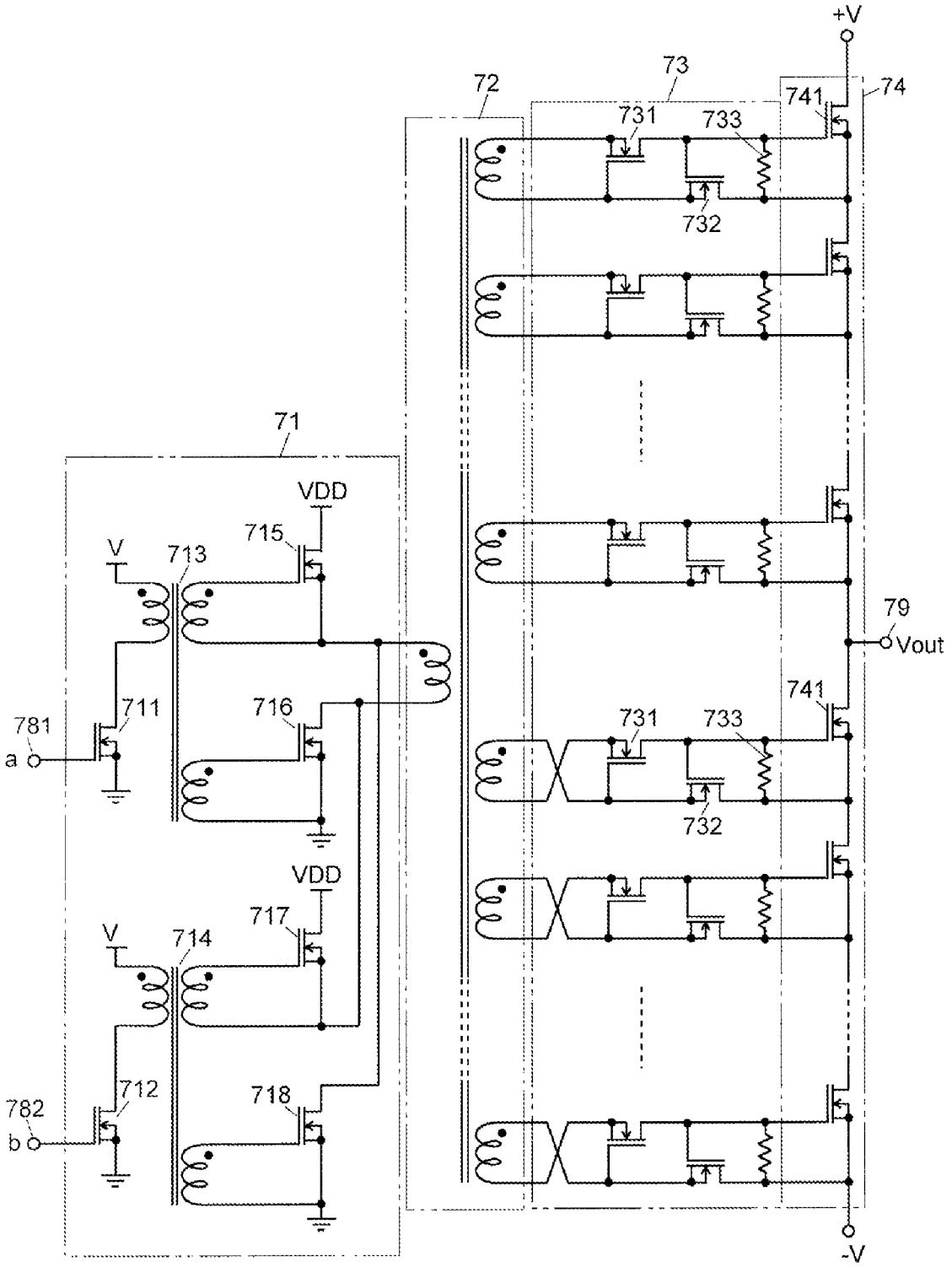
FIG. 3 is a schematic diagram showing a circuit configuration of the acceleration voltage generator in the OA-TOFMS according to the present embodiment.
Figure 13:
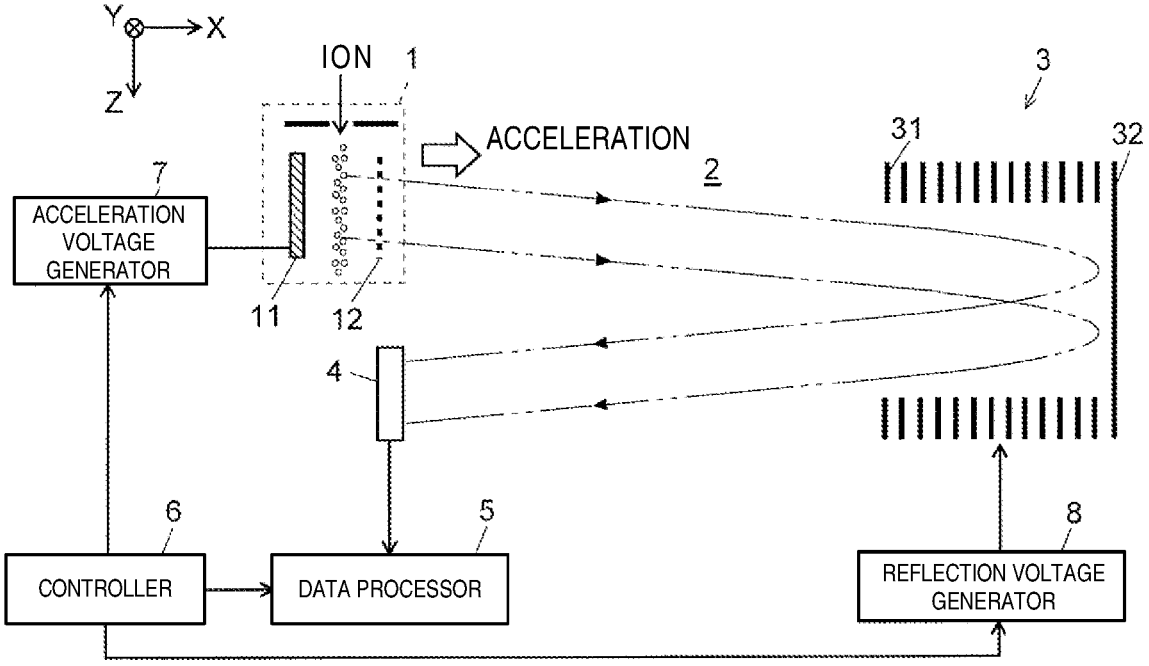
FIG. 13 is a schematic configuration diagram of a typical OA-TOFMS.

FIG. 1 is a schematic configuration diagram showing the OA-TOFMS according to the present embodiment, and FIG. 3 is a schematic diagram showing the circuit configuration of an acceleration voltage generator. Structural components which are identical to those already described and shown in FIG. 13 are denoted by the same numerals as used in FIG. 13, and detailed descriptions of those components will be omitted. The data processor 5 depicted in FIG. 13 is omitted from FIG. 1 to avoid too much complexity.

In the OA-TOFMS according to the present embodiment, the acceleration voltage generator 7 includes: a primary-side drive section 71; a transformer 72; a secondary-side drive section 73; a switch section 74; a high-voltage power supply 75; a primary-side power supply 76; and a temperature sensor 77. A controller 6 includes a primary-side voltage controller 61, and a primary-side voltage setting table 62. Typically, the controller 6 is mainly configured with a microcomputer including a central processing unit (CPU), a read-only memory (ROM), a random-access memory (RAM), and the like. However, it is needless to say that the controller 6 may be realized with a hardware circuit, such as a field-programmable gate array (FPGA), having a function equivalent to the microcomputer.

As shown in FIG. 3, the switch section 74 in the acceleration voltage generator 7 has a configuration in which power MOSFETs (hereinafter simply referred to as "MOSFET") 741 are serially connected in multiple stages (six stages in this embodiment) in both the positive side (above a voltage output terminal 79 in FIG. 3) and the negative side (below the voltage output terminal 79 in FIG. 3). The voltage or −V applied between the two ends of the switch section 74 from the high-voltage power supply 75 is changed according to the polarity of the target ions. For example, when the polarity of the ions is positive, +V=2500V and −V=0V. The transformer 72 is a ring-core transformer. One ring core is provided for the gate terminal of the MOSFET 741 in each of the multiple stages of the switch section 74 (i.e., 12 ring cores are provided). The secondary winding wound on each of the ring cores is connected to MOSFETs 731 and 732 in the secondary-side drive section 73. The primary winding is a single turn of cable passed through all ring cores. For the cable, a high-voltage insulated wire is used, which electrically insulates the primary side from the secondary side. The number of turns of the secondary winding may be any number.

Figure 2:
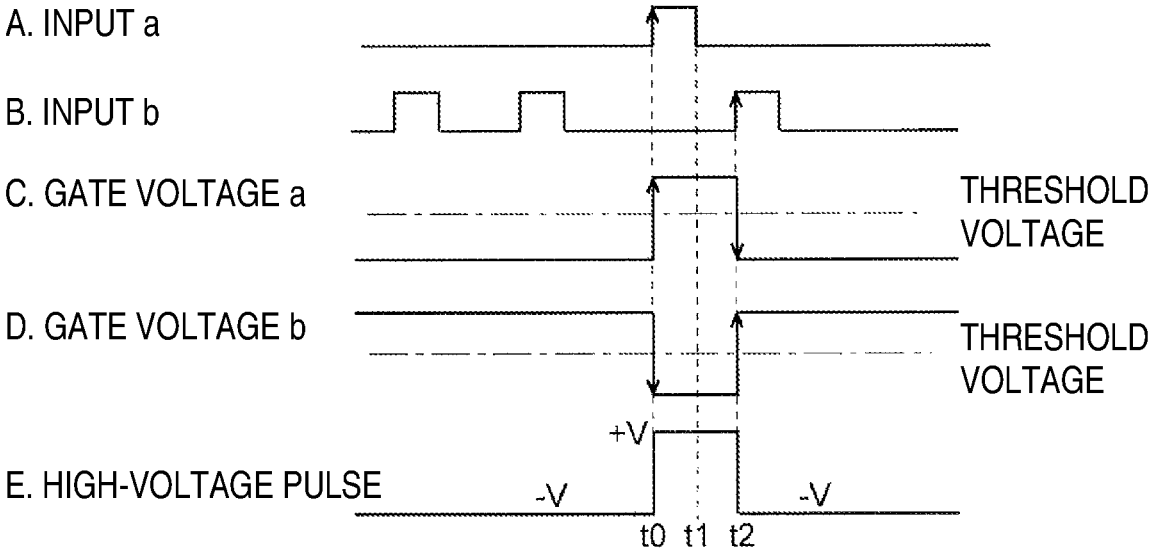
FIGS. 2A-2E are waveform charts showing the voltages in the main components of an acceleration voltage generator of the OA-TOFMS according to the present embodiment.

The primary-side drive section 71 includes a plurality of MOSFETs 711, 712 and 715 to 718, and a plurality of transformers 713 and 714. The primary-side drive section 71 further includes a positive-side pulse signal input terminal 781 and a negative-side pulse signal input terminal 782, to which pulse signals a and b are respectively inputted from the controller 6. As shown in FIGS. 2A and 2B, while the voltage of the pulse signal b fed to the negative-side pulse signal input terminal 782 is at the level of zero, the pulse signal a at the high level is fed to the positive-side pulse signal input terminal 781 at time t0, whereupon the MOSFET 711 is turned on. As a result, electric current flows in the primary winding of the transformer 713, inducing a predetermined voltage between the two ends of the secondary winding. Thus, the MOSFETs 715 and 716 are both turned on. Meanwhile, the MOSFET 712 stays in the off-state, and no current flows in the primary winding of the transformer 714. Accordingly, the MOSFETs 717 and 718 both stay in the off-state. Accordingly, a voltage of about VDD is applied between the two ends of the primary winding of the transformer 72, and the current flows in this primary winding downwards in FIG. 3.

This induces a predetermined voltage between the two ends of each of the secondary windings in the transformer 72. In this situation, the voltage applied to the gate terminal of each of the MOSFETs in the switch section 74 via the MOSFETs 731 and 732, and a resistor 733 included in the secondary-side drive section 73 is roughly expressed by the following formula:

$$[\text{gate voltage}] \approx \{[\text{primary-side voltage of transformer } 72]/[\text{the number of serial stages of MOSFETs } 741 \text{ in switch section } 74]\} \times [\text{the number of turns of secondary winding in transformer } 72] \quad (1),$$

For example, when the primary-side voltage (VDD) of the transformer 72 is 175V, the number of serial stages of the MOSFETs 741 in the switch section 74 is 12, and the number of turns of the secondary winding of the transformer 72 is one, a voltage which is approximately equal to ((175/12)×1)=14V is applied to the gate terminal of each of the MOSFETs 741 in the switch section 74.

In the positive side of the switch section 74, the above voltage is applied in the forward direction between the gate terminal and the source terminal of each of the six MOSFETs 741, so that these MOSFETs 741 are turned on. By comparison, in the negative side of the switch section 74, the above voltage is applied in the reverse direction between the gate terminal and the source terminal of each of the six MOSFETs 741, so that these MOSFETs 741 are turned off. As a result, the voltage-supplying terminal of the high-voltage power supply 75 is almost directly connected to the voltage output terminal 79. Thus, an output voltage of +V=+2500V appears at the voltage output terminal 79.

When the level of the pulse signal a fed to the positive-side pulse signal input terminal 781 is changed to the low level (voltage zero) at time t1, the voltage between the two ends of the primary winding of the transformer 72 becomes zero. However, the voltage applied to the gate terminal of each of the MOSFETs 741 is maintained by the secondary-side drive section 73 and the gate input capacitance C of the MOSFET 741. With this, the output voltage from the voltage output terminal 79 is maintained at +V=+2500V. Thereafter, at time t2, the pulse signal b fed to the negative-side pulse signal input terminal 782 is changed to the high level. This time, the MOSFET 712 is turned on. Along with this, the MOSFETs 717 and 718 are turned on, whereupon a voltage in the opposite direction to the previous case is applied between the two ends of the primary winding of the transformer 72. Thus, the current flows in the reverse direction. With this, a voltage is induced between the two ends of each secondary winding of the transformer 72 in the opposite direction to the previous case. Thus, the MOSFETs 741 on the positive side of the switch section 74 are turned off, whereas the MOSFETs 741 on the negative side are turned on. Accordingly, the output voltage from the voltage output terminal 79 becomes zero.

Figure 4:
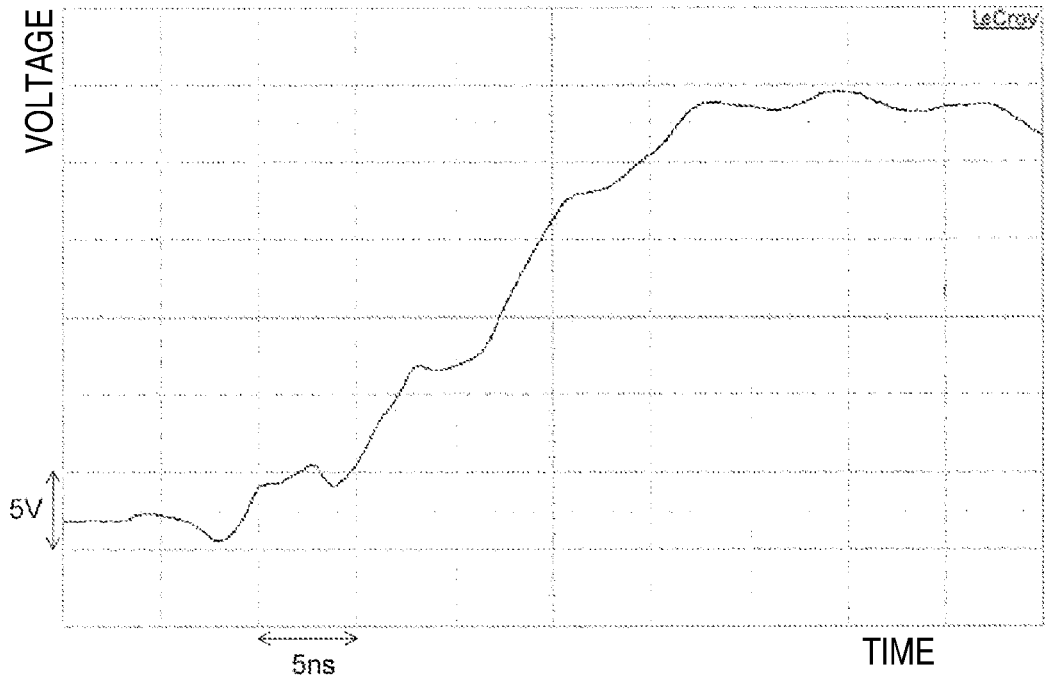
FIG. 4 is a graph showing a measured waveform of a gate voltage in a MOSFET for turning on and off a high voltage.
Figure 5:
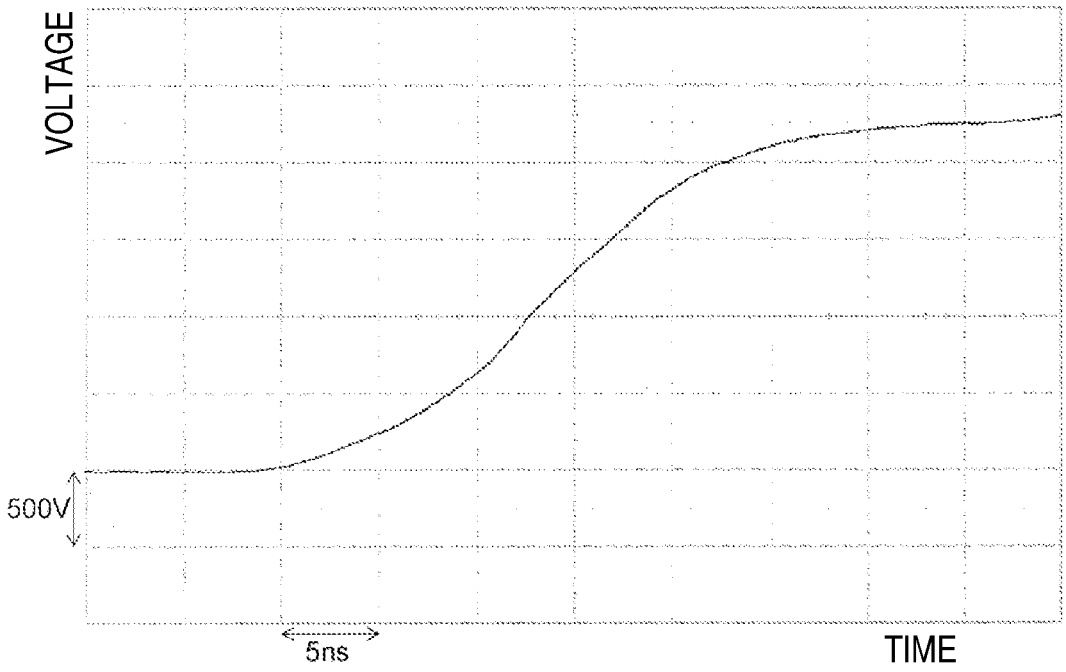
FIG. 5 is a graph showing a measured waveform of an output voltage (high-voltage pulse waveform).

The acceleration voltage generator 7 generates a high-voltage pulse with the previously described operations at a timing corresponding to the pulse signals a and b fed to the positive-side pulse signal input terminal 781 and the negative-side pulse signal input terminal 782. FIG. 4 is a graph showing a measured waveform of the gate voltage of each of the MOSFETs 741 during a change of the gate voltage from a negative voltage to a positive voltage. FIG. 5 is a graph showing a waveform of the output voltage Vout from the voltage output terminal 79 at this time. The horizontal axis is 5 [nsec/div] in each of the graphs.

In the above-mentioned acceleration voltage generator 7, the timing of the rise/fall of the positive and negative high-voltage pulses outputted from the voltage output terminal 79 is determined by the timing of the turning on/off of the MOSFETs 741 in the switch section 74, i.e., the timing of the rise/fall of the gate voltage of the MOSFETs 741. In the case of the waveforms shown in FIGS. 2A-2E, for example, the timing at which the high-voltage pulse changes from −V to +V shown in FIG. 2E is determined by both the timing at which the gate voltage of the MOSFETs 741 on the positive side (see FIG. 2C) changes from the negative voltage to the positive voltage, and the timing at which the gate voltage of the MOSFETs 741 on the negative side (see FIG. 2D) changes from the positive voltage to the negative voltage. Typically, the threshold value of a gate voltage for a MOSFET is several V (about 3V in this embodiment). When the rising slope of the gate voltage crosses this threshold voltage, the MOSFETs 741 are changed from the off-state to the on-state.

Figure 6:
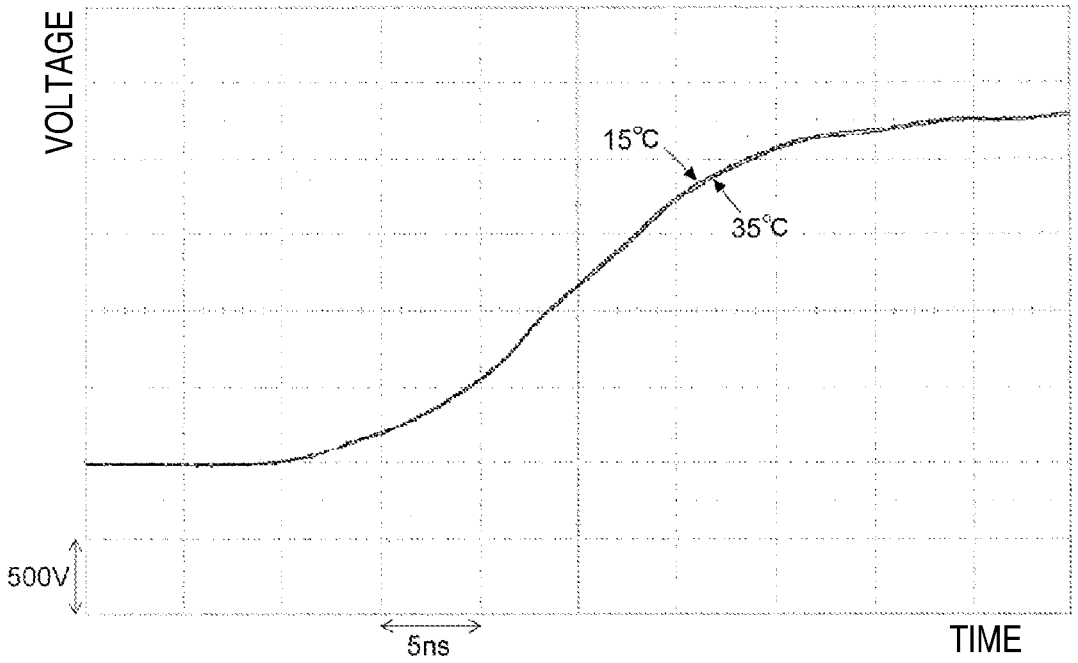
FIG. 6 is a graph showing a measured waveform of the output voltage in the case of changing the ambient temperature without performing a rising-time correction.
Figure 7:
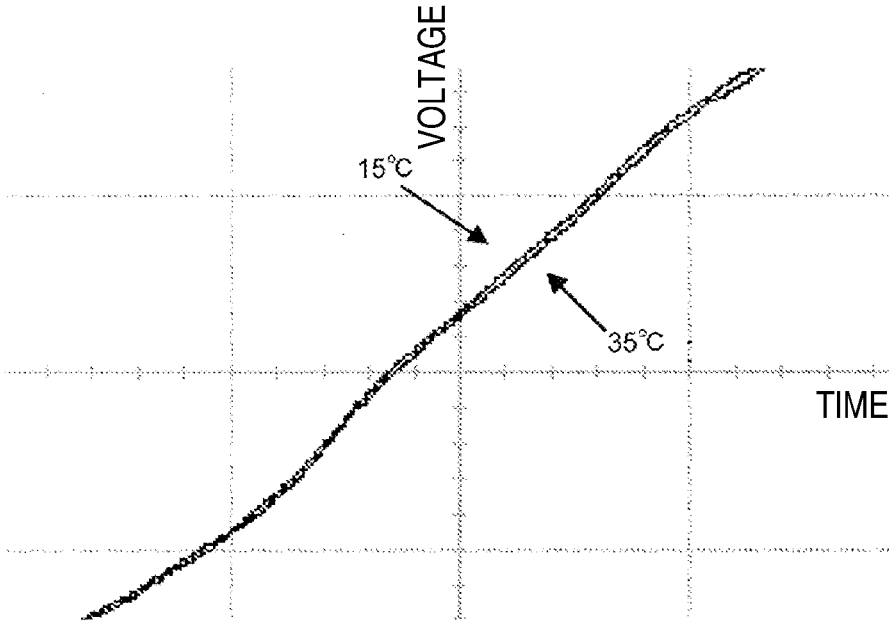
FIG. 7 is a partially enlarged view of the graph shown in FIG. 6.

FIG. 6 shows a measured waveform of the output voltage Vout when the ambient temperature of the acceleration voltage generator 7 is changed. FIG. 7 is a partially enlarged view of the graph shown in FIG. 6. The ambient temperatures shown here are 15° C. and 35° C. As seen from FIGS. 6 and 7, when the ambient temperature is changed from 15° C. to 35° C., the timing of the rise of the high-voltage pulse is delayed by about 200 [ps]. This is presumably caused by, for example, the temperature dependence of the rise/fall characteristics and signal propagation characteristics of a logic IC (not shown) that generates a pulse signal, or the like. The pulse signal is supplied to the semiconductor elements, such as the MOSFETs 741 in the switch section 74, and the MOSFETs 711, 712, and 715 to 718 in the primary-side drive section 71, the positive-side pulse signal input terminal 781, and the negative-side pulse signal input terminal 782. In the case of the OA-TOFMS according to the present embodiment, the delay of 200 [ps] in the timing of the rise of the high-voltage pulse causes a mass discrepancy of about several ppm for ions of m/z 1000. A precise mass measurement requires that a mass discrepancy be controlled at 1 ppm or less; however, the mass discrepancy caused by the above change in the temperature largely exceeds the value.

In view this, the OA-TOFMS according to the present embodiment resolves the time discrepancy in the waveform of the output voltage due to the change in the temperature and enhances the mass accuracy as follows.

Figure 8:
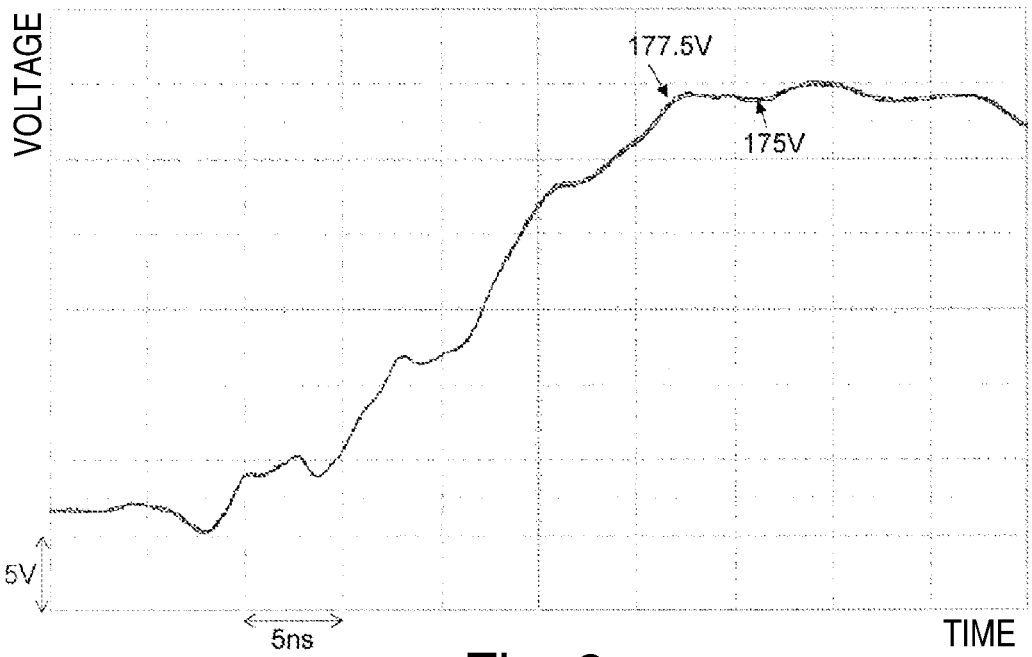
FIG. 8 is a graph showing a measured waveform of the gate voltage in the case of changing the primary-side voltage of a transformer from 175V to 177.5V.
Figure 9:
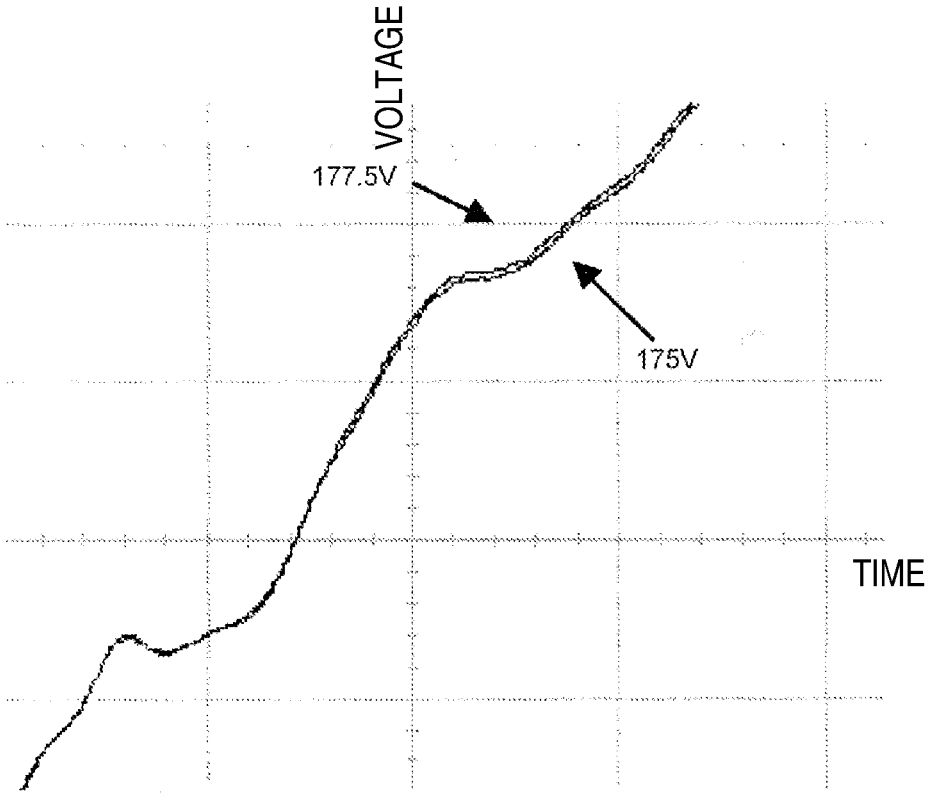
FIG. 9 is a partially enlarged view of the graph shown in FIG. 8.
Figure 10:
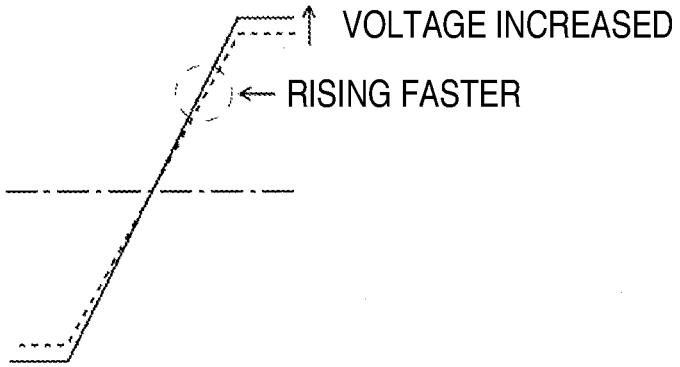
FIG. 10 is a model diagram showing the rising slopes of the voltage in FIG. 8.

FIG. 8 is a graph showing a measured waveform of the gate voltage of each of the MOSFETs 741 in the case of increasing the primary-side voltage of the transformer 72 from 175V to 177.5V, and FIG. 9 is a partially enlarged view of the graph shown in FIG. 8. FIG. 10 is a model diagram showing the rising slopes of the voltage in FIG. 8. As seen from FIGS. 8 and 9, when the primary-side voltage of the transformer 72 is increased from 175V to 177.5V, the gate voltage reaches the threshold voltage about 200 [ps] faster. In response to the increase in the primary-side voltage, the voltage applied to the gate terminal of each of the MOSFETs 741 via the secondary-side drive section 73 is increased from 14V to about 14.8V. As just described, the increase in the voltage applied to the gate terminal of each of the MOSFETs 741 causes an increase in charge current for charging the gate input capacitance C of the MOSFETs 741. This presumably causes faster rise in the voltage as shown in FIG. 10.

Figure 11:
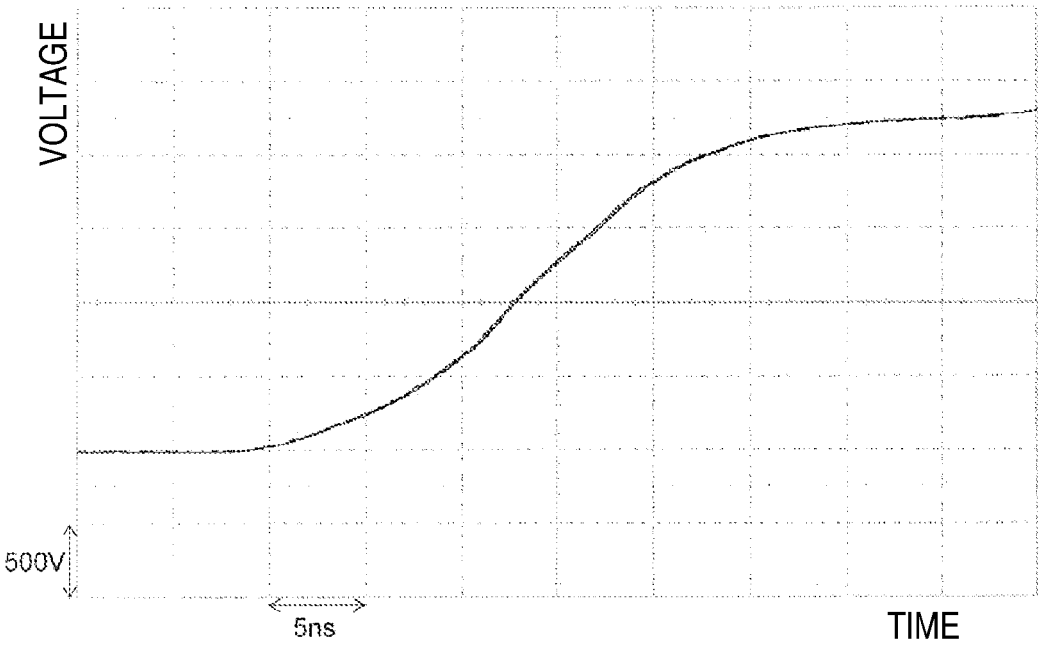
FIG. 11 is a graph showing a measured waveform of the output voltage in the case of changing the primary-side voltage of the transformer from 175V to 177.5V.
Figure 12:
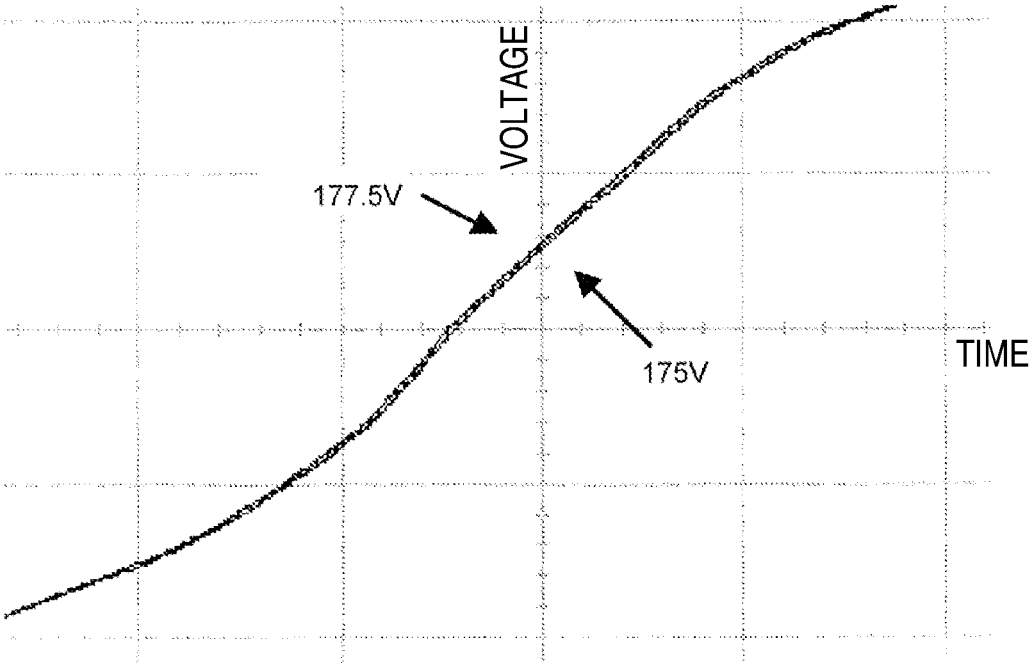
FIG. 12 is a partially enlarged view of the graph shown in FIG. 11.

FIG. 11 is a graph showing the measured waveform of the output voltage at this time, and FIG. 12 is a partially enlarged view of the graph shown in FIG. 11. When the primary-side voltage of the transformer 72 is increased from 175V to 177.5V, the timing of the rise of the high-voltage pulse is also about 200 [ps] faster.

The OA-TOFMS according to the present embodiment utilizes the above-mentioned fact that the high-voltage pulse rises faster in response to the increase in the primary-side voltage of the transformer 72, and thus corrects the time discrepancy in the rise/fall of the high-voltage pulse during the change in the ambient temperature of the acceleration voltage generator 7.

More specifically, the OA-TOFMS previously obtains the relationship between the change in the ambient temperature and the temporal change in the rise/fall of the high-voltage pulse, and the relationship between the change in the primary-side voltage of the transformer 72 and the temporal change in the rise/fall of the high-voltage pulse. The primary-side voltage setting table 62 stores the information that indicates these relationships. The relationships are dependent on components, elements, and the like used in the acceleration voltage generator 7. It is therefore possible for a manufacturer of the OA-TOFMS to experimentally determine the relationships and store the relationships in the primary-side voltage setting table 62 in advance. For example, the relationship between the change in the ambient temperature and the temporal change in the rise/fall of the high-voltage pulse can be expressed by a variation of +10 [ps/° C.], and the relationship between the change in the primary-side voltage of the transformer 72 and the temporal change in the rise/fall of the high-voltage pulse can be expressed by a variation of −80 [ps/V]. For example, the variations herein are variations relative to standard values, such as 15° C. for the ambient temperature and 175V for the primary-side voltage of the transformer 72. When the relationships are non-linear, a different format, such as a formula or a table, showing a correspondence relationship may be used.

In the actual measurement, the temperature sensor 77 measures the ambient temperature of the acceleration voltage generator 7, and sends the information on the measured ambient temperature to the controller 6 in almost real time. As described above, the time discrepancy in the rise/fall of the high-voltage pulse is most influenced by the switch section 74 (MOSFETs 741). The temperature sensor 77 is therefore preferably installed to measure a temperature in the vicinity of the switch section 74. In the controller 6, the primary-side voltage controller 61 reads the information indicating the above-mentioned relationships from the primary-side voltage setting table 62. The primary-side voltage controller 61 then calculates the time discrepancy relative to the temperature at the current point in time and also calculates the change in the primary-side voltage for correcting the time discrepancy to determine the primary-side voltage.

The primary-side voltage controller 61 informs the primary-side power supply 76 of the calculated primary-side voltage. The primary-side power supply 76 generates the specified direct-current voltage and applies it to the primary-side drive section 71 as VDD. The voltage applied to the primary winding of the transformer 72 is thereby adjusted according to the ambient temperature at this time, and the high-voltage pulse with no time discrepancy is generated and applied to the push-out electrode 11 and the extraction electrode 12. As a result, a high level of mass accuracy can always be achieved without being dependent on the ambient temperature of the acceleration voltage generator 7.

The aforementioned embodiment is merely an example of the present invention, and any change, addition, or modification appropriately made within the spirit of the present invention will naturally fall within the scope of claims of the present application.

For example, as opposed to the previous embodiment, in which the present invention is applied to an OA-TOFMS, the present invention can be applied to other types of time-of-flight mass spectrometer, such as an ion trap time-of-flight mass spectrometer in which ions held in a three-dimensional quadrupole ion trap or linear ion trap are accelerated and sent into a flight space, or a time-of-flight mass spectrometer in which ions generated from a sample in a MALDI or similar ion source are accelerated and sent into a flight space.

REFERENCE SIGNS LIST

1 . . . Ion Ejector
11 . . . Push-out Electrode
12 . . . Extraction Electrode
2 . . . Flight Space
3 . . . Reflector
31 . . . Reflection Electrode
32 . . . Back Plate
4 . . . Detector
5 . . . Data Processor
6 . . . Controller
61 . . . Primary-side Voltage Controller
62 . . . Primary-side Voltage Setting Table
7 . . . Acceleration Voltage Generator
71 . . . Primary-side Drive Section
711, 712, 715 to 718, 731, 732, 741 . . . MOSFET
72, 713 . . . Transformer
73 . . . Secondary-side Drive Section
733 . . . Resistor
74 . . . Switch Section
75 . . . High-voltage Power Supply
76 . . . Primary-side Power Supply
77 . . . Temperature Sensor
8 . . . Reflection Voltage Generator

The invention claimed is:

1. A time-of-flight mass spectrometer provided with a flight space through which ions fly, an ion ejector for ejecting ions to be measured into the flight space by imparting acceleration energy to the ions by an effect of an electric field created by a voltage applied to an electrode, and an ion detector for detecting the ions having flown through the flight space, the time-of-flight mass spectrometer comprising:

a) a high-voltage pulse generator for applying, to the electrode of the ion ejector, a high-voltage pulse for ejecting ions, the high-voltage pulse generator including: a direct-current power supply for generating a high direct-current voltage; a transformer including a primary winding and a secondary winding; a primary-side drive circuit section for supplying drive current to the primary winding of the transformer in response to an input of a pulse signal for ejecting ions; a secondary-side drive circuit section connected to the secondary winding of the transformer; a switching element to be driven by the secondary-side drive circuit section to turn on and off for generating a voltage pulse from the high direct-current voltage generated by the direct-current power supply; and a primary-side power supply for generating a voltage to be applied between two ends of the primary winding of the transformer through the primary-side drive circuit section;

b) a temperature measurement section for measuring an ambient temperature of the high-voltage pulse generator; and c) a controller for controlling the primary-side power supply to change the voltage to be applied between the two ends of the primary winding of the transformer in the high-voltage pulse generator, according to the temperature measured by the temperature measurement section.

2. The time-of-flight mass spectrometer according to claim 1, wherein the controller includes a storage section for storing information showing a relationship between a change in the ambient temperature and a temporal change in the high-voltage pulse to be outputted and information showing a relationship between a change in the voltage applied between the two ends of the primary winding of the transformer and the temporal change in the high-voltage pulse to be outputted, and controls the primary-side power supply based on the information stored in the storage section.

* * * * *